US006067913A

United States Patent [19]

Bennett

[11] Patent Number: 6,067,913

[45] Date of Patent: May 30, 2000

[54] STACKABLE PALLET SYSTEM FOR TRANSPORTING GAS CONTAINERS

[76] Inventor: Richard C. Bennett, 710 - 2 Diamond Lake Rd., Mundelein, Ill. 60060

[21] Appl. No.: 09/182,957

[22] Filed: Oct. 30, 1998

[51] Int. Cl.[7] ..... B65D 19/00

[52] U.S. Cl. ..... 108/53.5; 206/597

[58] Field of Search ..... 108/53.5, 53.1, 108/51.11; 206/386, 597

[56] References Cited

U.S. PATENT DOCUMENTS

| | | | |
|---|---|---|---|
| D. 265,602 | 7/1982 | Winqvist . | |
| D. 338,092 | 8/1993 | Payne et al. . | |
| 2,322,748 | 6/1943 | Shaw et al. | 108/53.5 |
| 3,522,954 | 8/1970 | Locke | 108/53.5 |
| 3,602,368 | 8/1971 | Gould . | |
| 3,638,790 | 2/1972 | Schmid et al. . | |
| 3,710,732 | 1/1973 | Phelps . | |
| 3,762,343 | 10/1973 | Thacker | 108/53.5 |
| 3,791,403 | 2/1974 | Folkerth . | |
| 3,993,344 | 11/1976 | Bennett . | |
| 4,113,118 | 9/1978 | Glumac | 108/53.5 |
| 4,295,431 | 10/1981 | Stavlo . | |
| 4,391,377 | 7/1983 | Ziaylek, Jr. . | |
| 4,481,972 | 11/1984 | Stavlo . | |
| 4,564,109 | 1/1986 | Stavlo . | |
| 4,642,007 | 2/1987 | Marshall et al. . | |
| 5,078,415 | 1/1992 | Goral . | |
| 5,154,556 | 10/1992 | Wappel . | |
| 5,176,265 | 1/1993 | Bennett . | |
| 5,378,106 | 1/1995 | Risley et al. . | |
| 5,573,360 | 11/1996 | Bennett . | |
| 5,709,252 | 1/1998 | Princiotta et al. . | |

FOREIGN PATENT DOCUMENTS

| | | | |
|---|---|---|---|
| 639769 | 12/1978 | U.S.S.R. | 108/53.5 |

*Primary Examiner*—Peter M. Cuomo
*Assistant Examiner*—Jerry A. Anderson
*Attorney, Agent, or Firm*—Seyfarth, Shaw, Fairweather & Geraldson

[57] ABSTRACT

A stackable pallet for transporting gas containers is provided. The pallet includes a frame structure for supporting the gas cylinders. The structure includes a lower end having a lower locking structure. The upper end has an upper locking structure shaped and dimensioned to be mateable with the lower locking structure of another like pallet to lock the pallets in a stacked arrangement. The pallets may form part of a stackable pallet system which includes a plurality of pallets, some of which may be locked together in a stacked arrangement to the bed of a trailer or other vehicle.

22 Claims, 12 Drawing Sheets

STACKABLE PALLET SYSTEM FOR TRANSPORTING GAS CONTAINERS

BACKGROUND OF THE INVENTION

1. Field of the Invention

This invention relates to pallets and pallet systems, and more particularly to pallet systems for transporting gas containers.

2. Description of the Prior Art

Palletized systems for transporting various gas containers, such as cylinders, have been previously provided. These systems typically include a plurality of pallets placed on or locked to the bed of a vehicle. Each pallet supports a given number of gas cylinders. Since, the necks of the gas cylinders extend above the top of the frame structure of each pallet, the pallets could only be stacked one high on the trailer. Thus, the number of cylinders which can be transported at one time is limited by the area of the vehicle bed.

SUMMARY OF THE INVENTION

It is a general object of the invention to provide an improved stackable pallet for transporting and supporting gas containers which avoids the disadvantages of prior pallets, while affording additional structural and operating advantages.

An improved feature of the invention is the feature of a pallet which is readily stackable on another pallet to afford more economical transportation of the gas containers.

Another feature of the invention is the provision of a pallet which is firmly and yet simply locked in place to either a vehicle bed or another pallet.

Still another feature of the invention is the provision of a pallet which can better maintain gas containers in its frame structure.

A still further feature of the invention is the provision of a pallet of the type set forth, which is of simple and economical construction.

Yet another feature of the present invention is the provision of a pallet of the type set forth having structure which easily guides and aligns another pallet above it in a stacked arrangement.

These and other features of the invention may be attained by providing a stackable pallet for transporting gas containers comprising a frame structure for supporting the gas containers. The structure including a lower end having a lower locking structure, and an upper end having an upper locking structure shaped and dimensioned to be mateable with the lower locking structure of another pallet to lock the pallets in a stacked arrangement.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
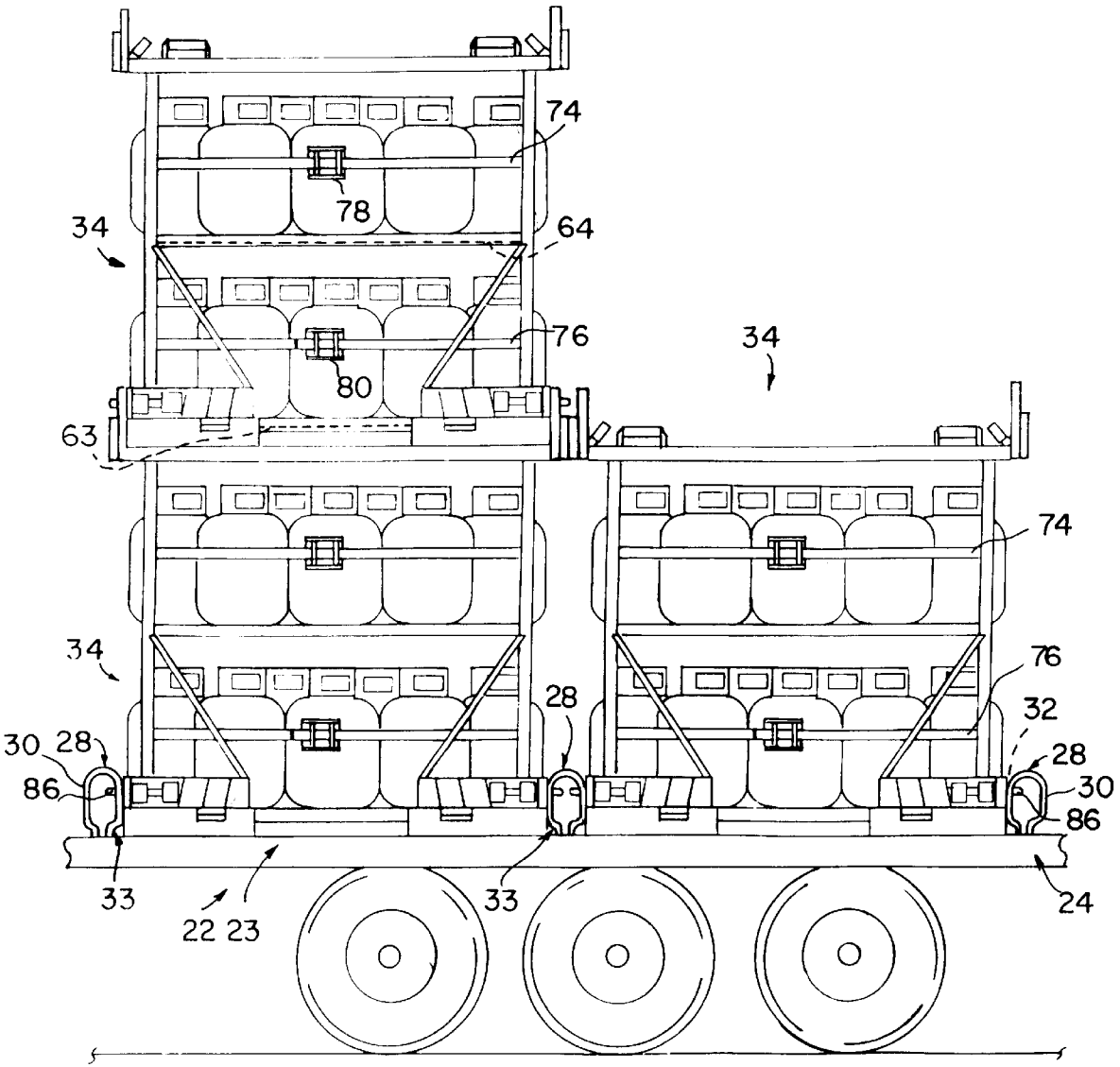
FIG. 1 is a partial side elevation view of the pallet system of the present invention.
Figure 9:
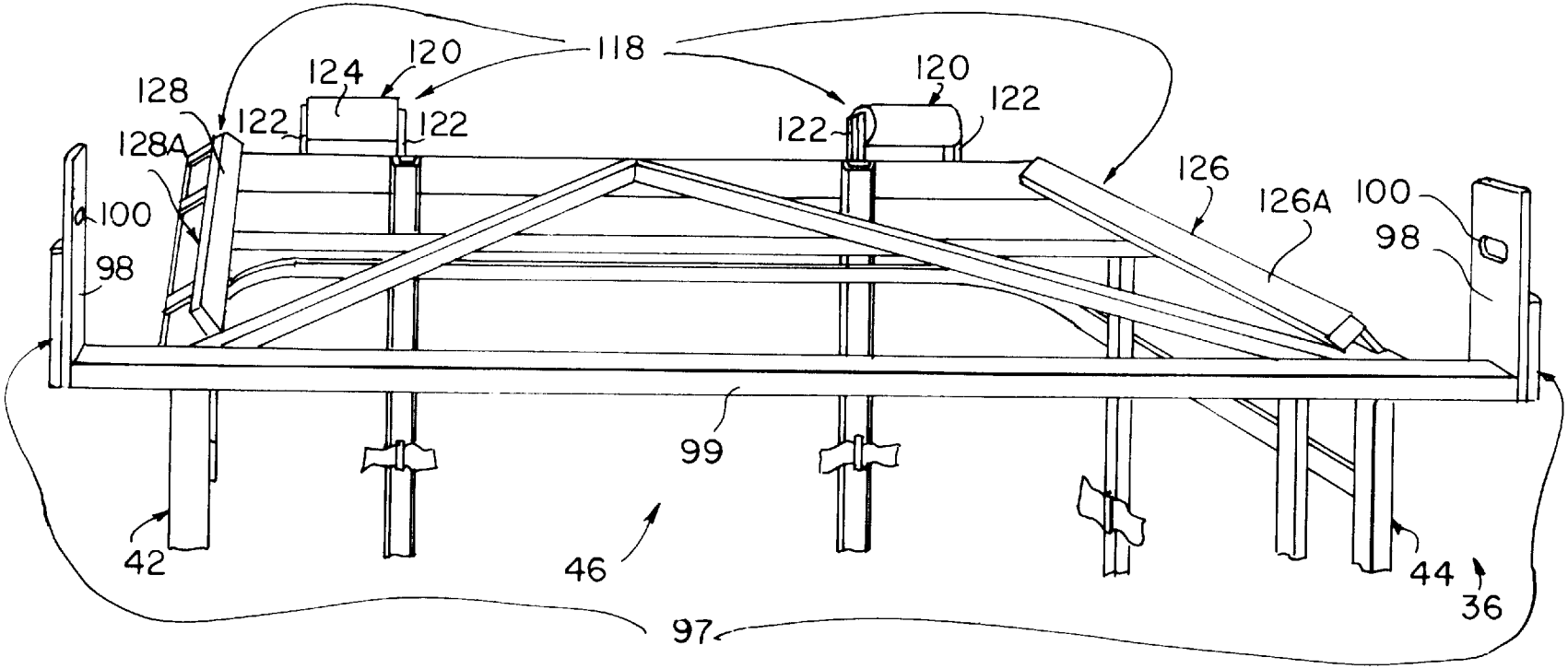
FIG. 9 is an enlarged, fragmentary, perspective view of the upper end of the pallet of FIG. 2.
Figure 15:
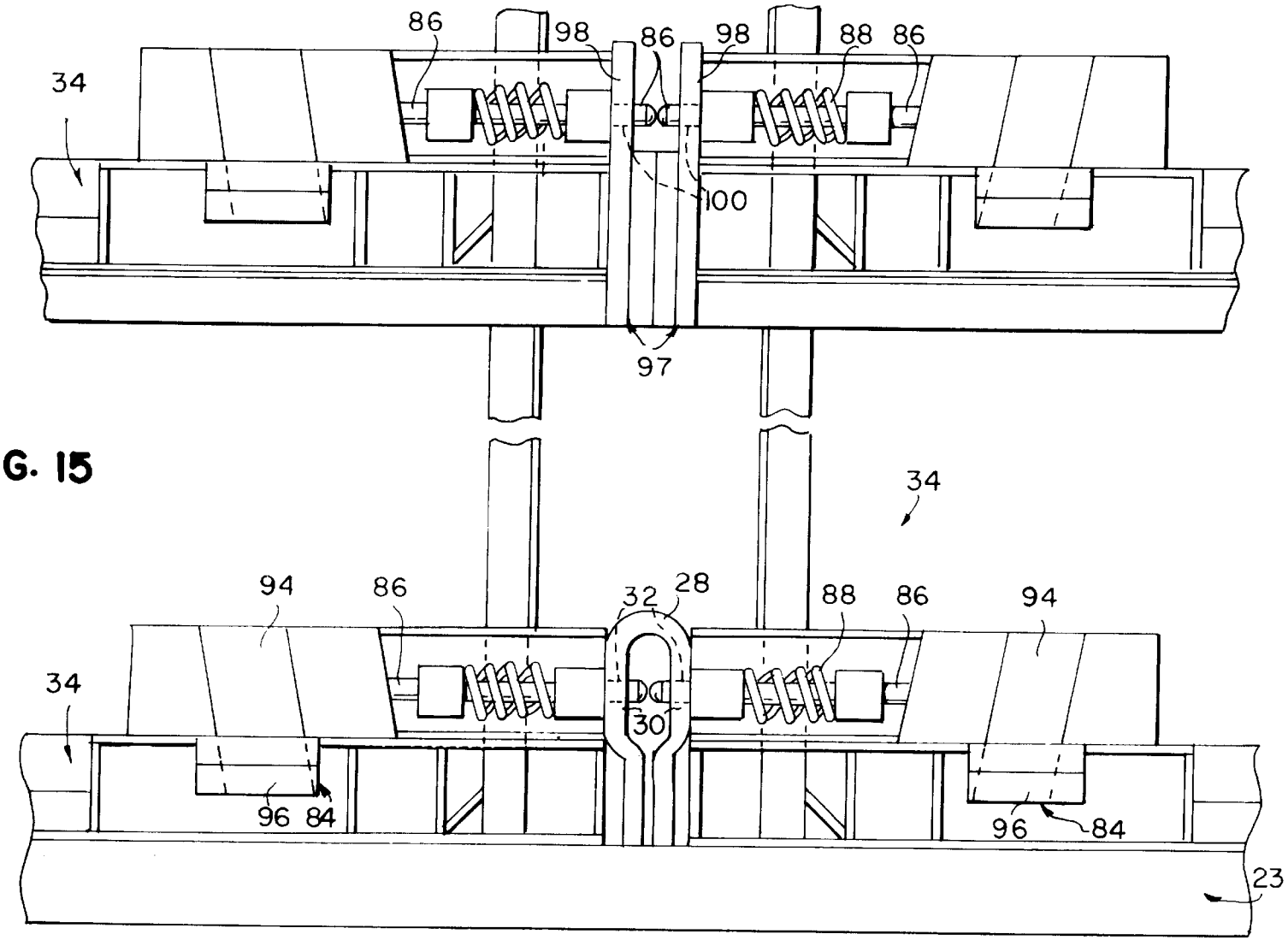
FIG. 15 is an enlarged, fragmentary, front elevation view illustrating the engaged locking mechanisms of pallets locked to one another in a stacked arrangement and to the bed of a trailer.

Turning now to the drawings, and more particularly to FIG. 1 thereof, there is illustrated a pallet transporting system 20 comprising a trailer 22. The trailer 22 may be of basically standard construction. The trailer 22 includes a load-supporting bed 24 made up, in part, of a pair of longitudinally extending side beams 24, a center beam 26 (FIG. 3) and cross beams. Mounted on each side beam 24 are a plurality of dividers 28, effectively dividing the bed 23 into bays, one bay between each pair of adjacent dividers 28. Each divider 28 includes a pair of spaced-apart, substantially parallel sidewalls 30. In each sidewall 30 is a keeper 32 which, in the form illustrated, is simply a hole (FIGS. 9 and 15). Two keepers 32 on adjacent dividers 28 facing each other form a bed locking structure 33 (FIG. 1). A typical trailer bed is more fully described in U.S. Pat. No. 5,573,360 to Bennett and entitled "Pallet Latching Mechanism," the specification of which is incorporated herein by reference.

Figure 2:
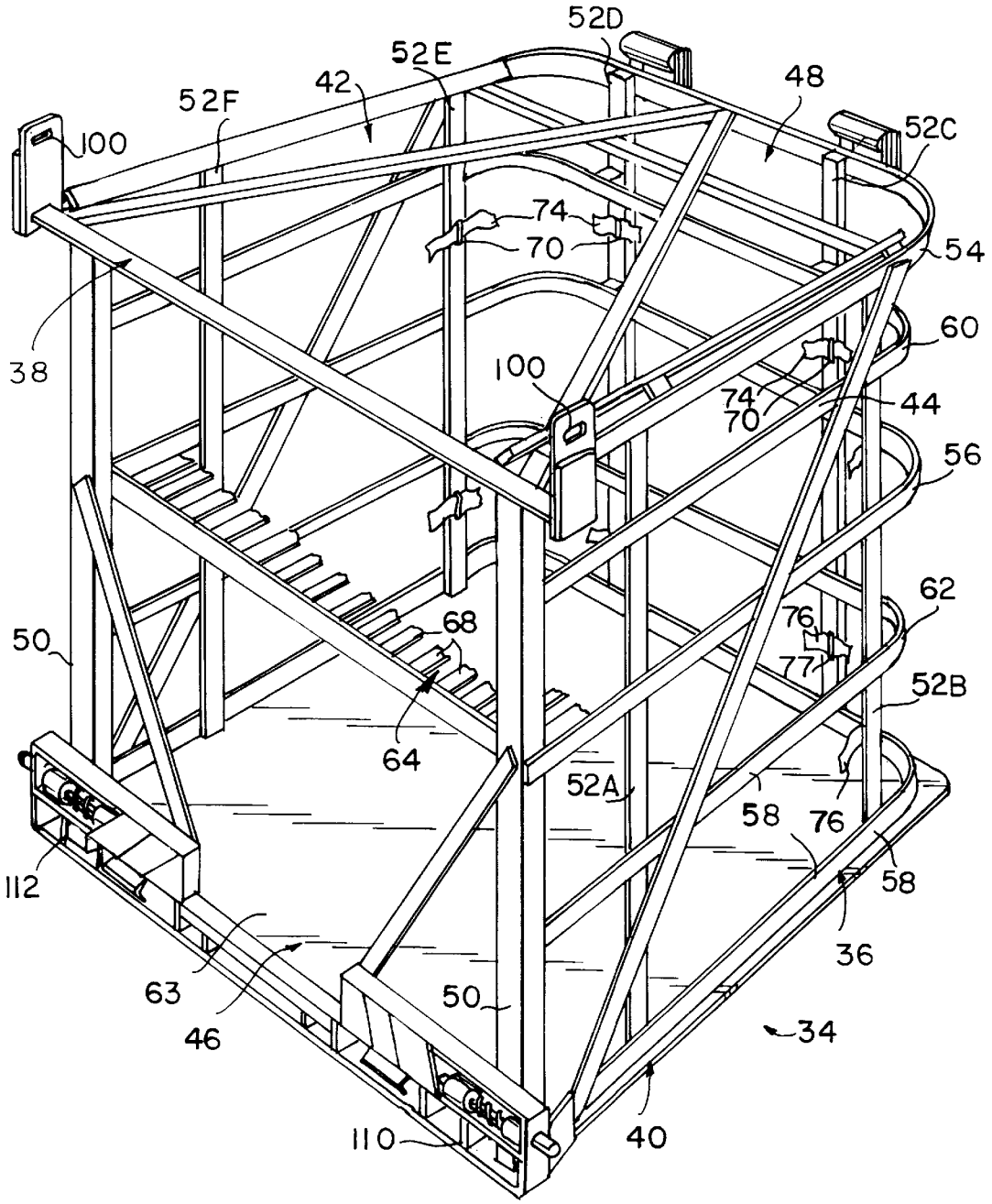
FIG. 2 is an enlarged perspective view of one of the pallets of FIG. 1, partially broken away.

The transporting system further comprises a plurality of identical pallets 34. As seen in FIG. 2, each pallet 34 includes a frame structure 36 having an upper end 38, a lower end 40, two substantially parallel sides 42, 44, a front end 46 and a rear end 48. The frame structure 36 also includes two vertical front posts 50 disposed at the front end 46 and six vertical peripheral posts 52A–F disposed about the sides 42, 44 and the rear end 48. The posts 50, 52A–F connect the upper and lower ends 38, 40.

The frame structure 36 also includes horizontal upper, middle and lower U-shaped outer members 54, 56, 58 connected to the posts 50, 52A–F and horizontal U-shaped upper and lower retaining members 60, 62 also connected to posts 50, 52A–F and having a length less than that of the members 54, 56 and 58.

The frame structure 36 also includes substantially planar lower and upper base floors 63, 64 for supporting gas containers, such as liquid propane tanks 66. The lower base floor 63 is preferably one-piece and is disposed at the lower end 40 adjacent the bottom of lower member 58, and the upper base floor 64 is disposed between the upper and lower ends 38, 40 adjacent the bottom of middle member 56 and formed of a plurality of spaced-apart, substantially parallel bars 68 running between the front and rear ends 46, 48.

The front end 46 does not have any vertical posts or horizontal members and is substantially open and serves as an area through which the liquid propane tanks 66 are loaded and unloaded.

Figure 3:
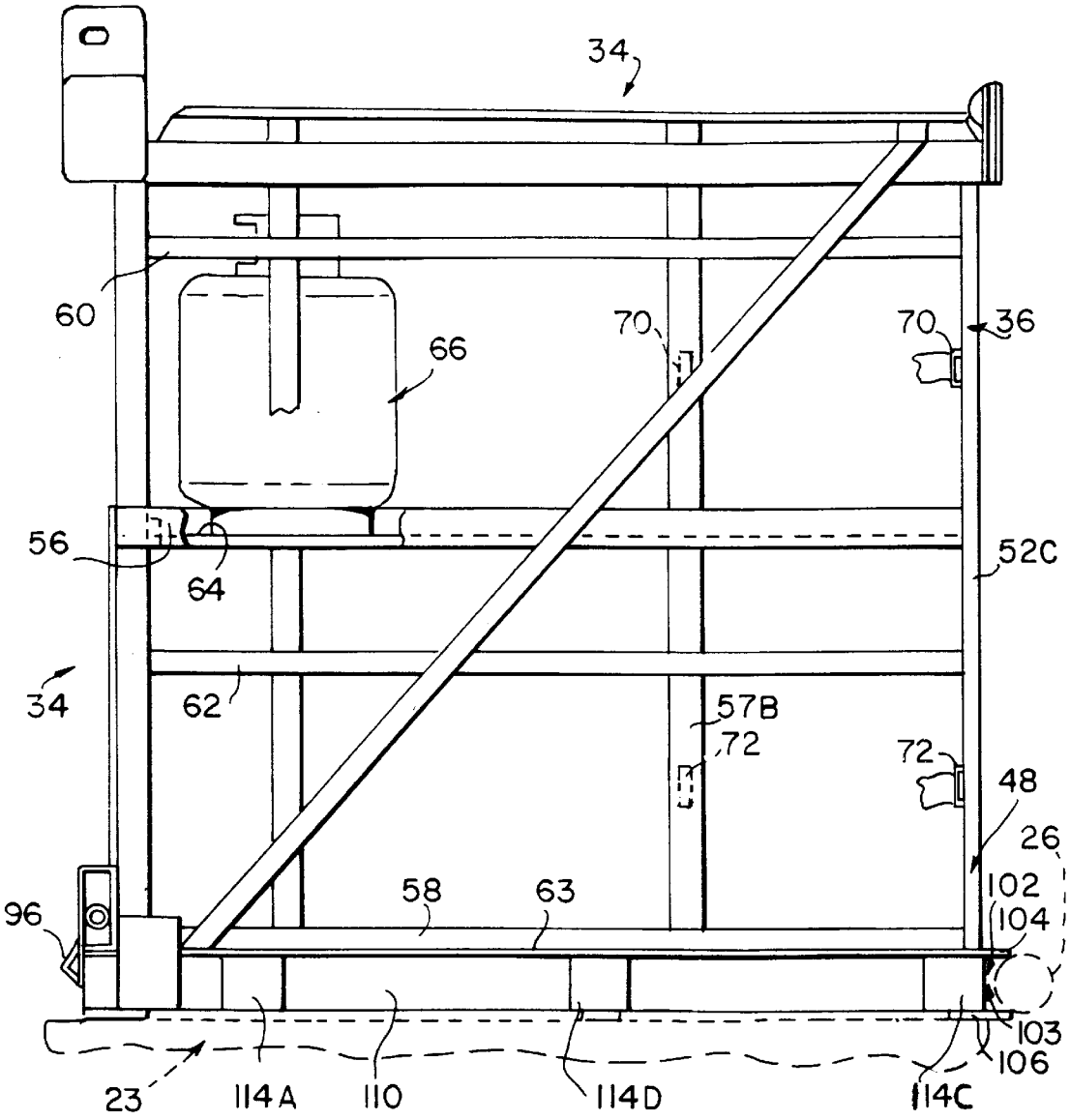
FIG. 3 is an enlarged side elevation view of one of the pallets of FIG. 1, partially broken away.

As seen in FIG. 3, the upper and lower retaining member 60 and 62 are, respectively, spaced above the upper and lower base floors 64 and 63 distances corresponding to the height of the neck of a propane tank 66 above its bottom. The tops of the middle and lower members 56 and 58 are, respectively, spaced above the base floors 64 and 63 distances corresponding to the height of the base of a propane tank 66.

Figure 10:
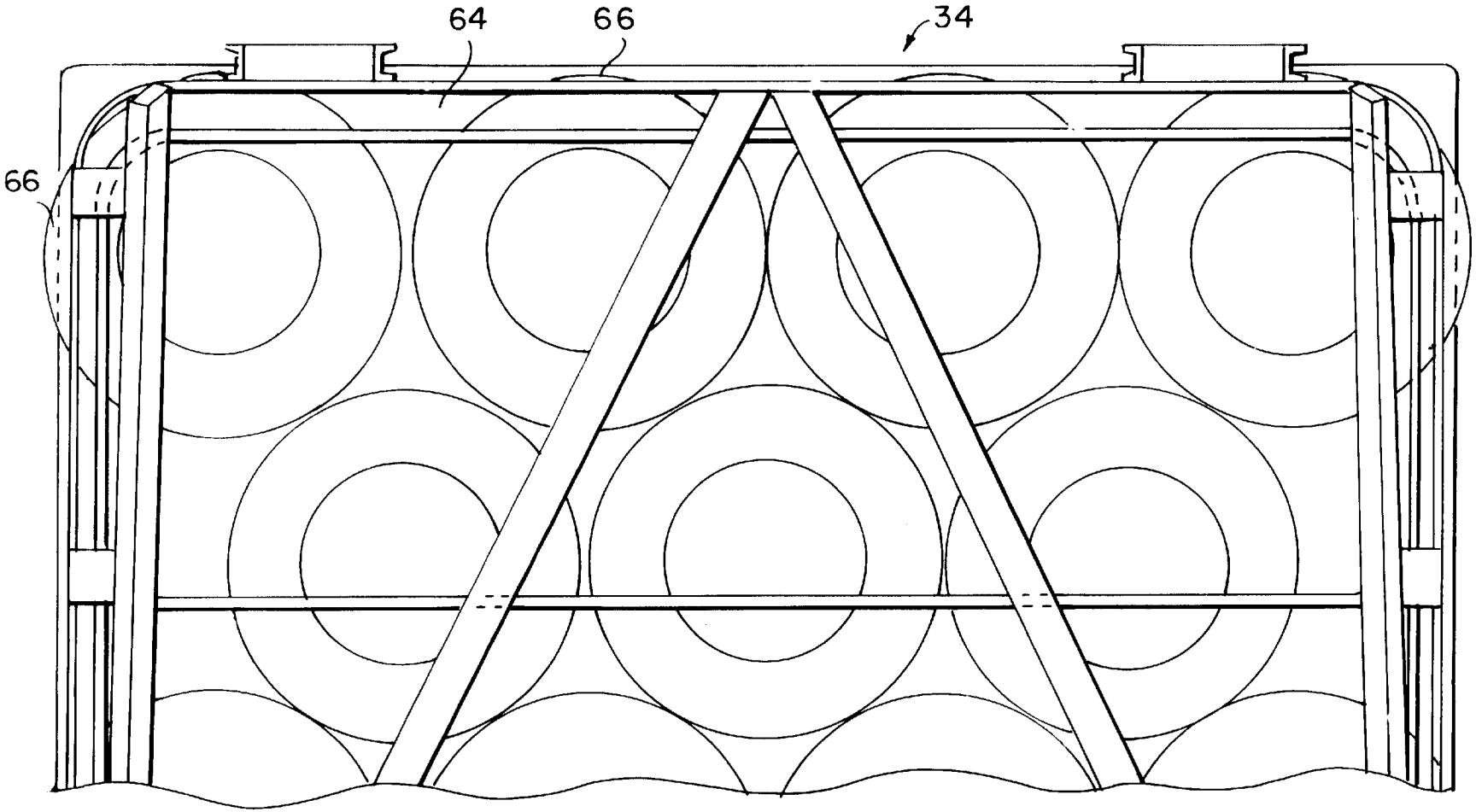
FIG. 10 is an enlarged, fragmentary, top plan view of the pallet of FIG. 2 loaded with gas cylinders.
Figure 11:
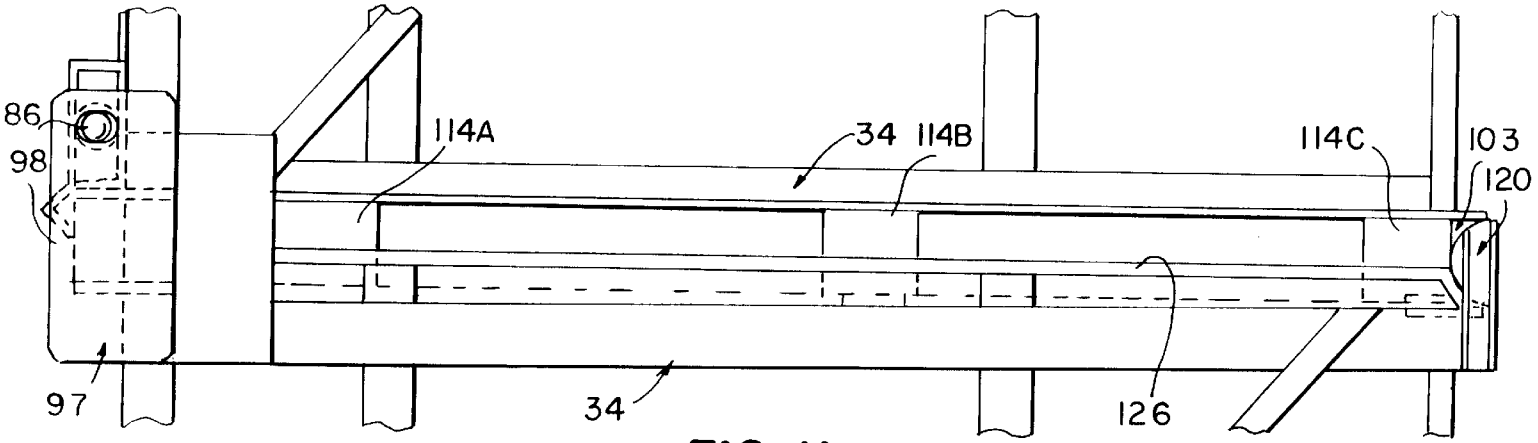
FIG. 11 is a fragmentary, side elevation view of the upper end of one pallet and the lower end of another pallet locked to the first pallet.

This spacing aids in retaining the liquid propane tanks 66 on the pallet 34 and allows the maximum number of liquid propane tanks 66 to be stored on both the lower base floor 63 and upper base floor 64. As seen in FIG. 10, this spacing allows a portion of the body of some of the liquid propane tanks 66 to overhang upper base floor 64 (and the lower base floor 63) without falling off the pallet 34.

Figure 4:
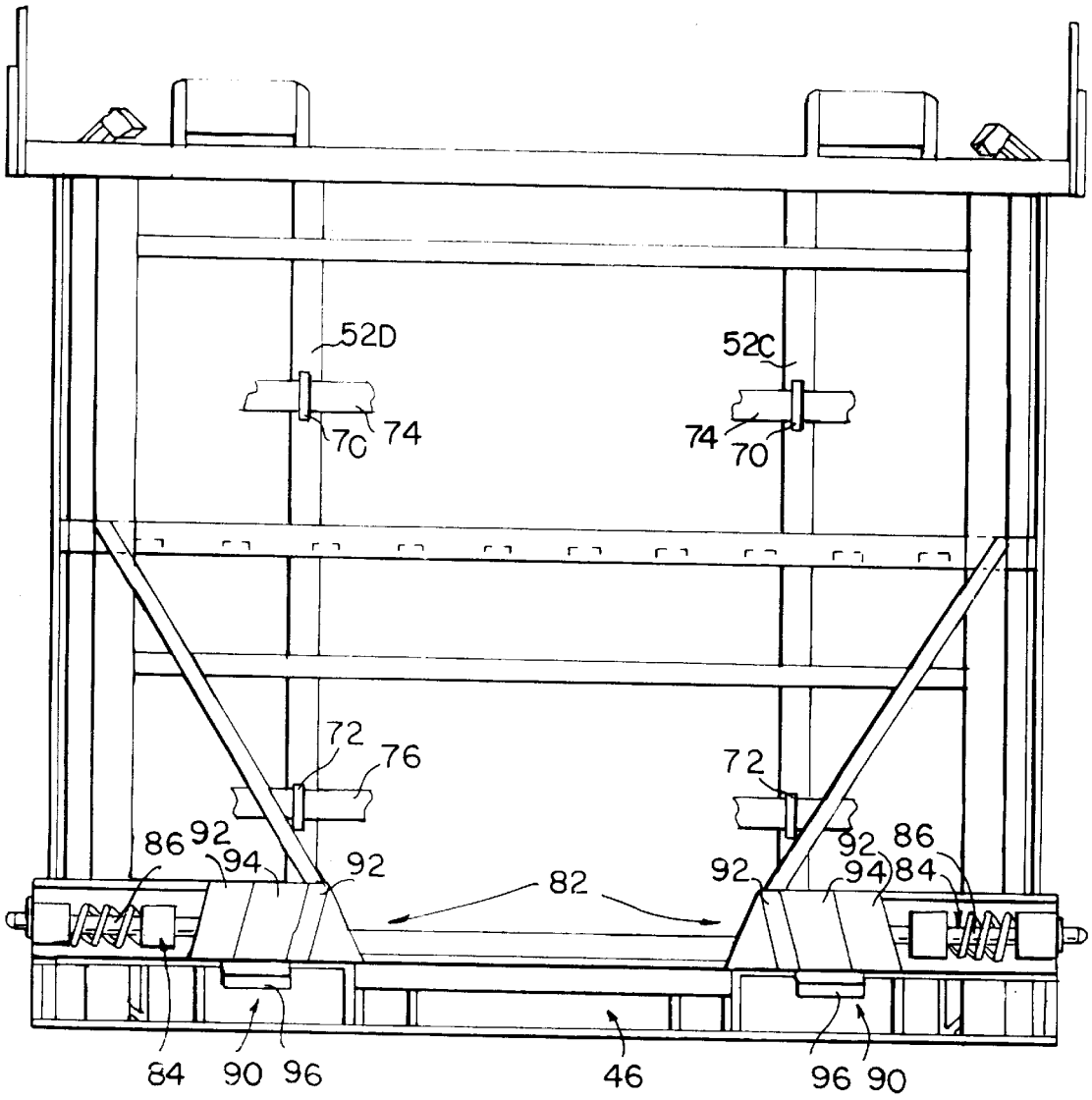
FIG. 4 is a front elevation view of the pallet of FIG. 2.

Additionally, as seen in FIGS. 2 and 4, posts 52B–E have upper and lower belt loops 70, 72 respectively having lock straps 74 and 76 disposed therethrough. As seen in FIG. 1, the belt loops 70, 72 and lock straps 74, 76 are respectively disposed at heights above the upper and lower base floors 64 and 63 so as to engage the larger diameter body portions of the liquid propane tanks 66 when the liquid propane tanks 66 are supported on the upper and lower base floors 64, 63. Buckles 78, 80 (FIG. 1), or other connecting devices, respectively connect the ends of the lock straps 74, 76 and are used to adjust the length the lock straps 74, 76, in a known manner, to tighten them about the liquid propane tanks 66 to further aid in maintaining the liquid propane tanks 66 in place on the pallet 34 and prevent them from falling off the substantially open front end 46. These straps 74, 76 and buckles 78, 80 are especially useful when the upper and lower base floors 64, 63 are not filled to capacity with the liquid propane tanks 66.

A significant aspect of the present invention is that the pallets 34 are lockable to either the bed 23 or to another pallet 34 in a stacked arrangement. The lower end 40 of each pallet 34, as seen in FIG. 4, has a lower locking structure 82. The lower locking structure 82 includes two latching mechanisms 84, one on each side of the front end 46. Each latching mechanism 84 includes a bolt 86 having a rounded end moveable between a latching position, as shown in the Figures, and an unlatching position when it is retracted inwardly toward the center of the front end 46. A spring 88 carried by the bolt 86 normally urges the bolt 86 outwardly to its latching position.

Each latching mechanism 84 also includes an actuator 90, which includes a pair of spaced-apart rails 92 defining an inclined guideway. A carriage plate 94 is slidably disposed between rails 92 in the guideway.

Welded to the lower end of each carriage plate 94 is an elongated diverter member 96 being V-shaped in transverse cross section. The lower surface of diverter member 96 constitutes a diverting surface to guide the fork of a lift truck to a position beneath carriage plate 94. The plate 94 is engageably coupled to the bolt 86. When an operator drives a fork lift truck forwardly so that the fork strikes diverter member 96, the plate 94 moves up causing the bolt 86 to be retracted and placed in an unlatched position.

When the fork of the truck is removed from under the carriage plate 94, the carriage plate 94 moves down causing bolt 86 to move outwardly to its latching position. The latching mechanism 84 is more fully described in U.S. Pat. No. 5,573,360 discussed above.

As seen in FIGS. 1 and 15, a pallet 34 is latched or locked to the bed 23 by aligning each of the bolts 86 with respective keepers 32 and latching the bolt 86 thereto, all in a known manner.

The upper end 38 of the frame structure 36 of pallet 34 has an upper locking structure 97 which mimics the bed locking structure 33 and includes a pair of substantially parallel plates 98 welded to and projecting up from the upper member 54. Plates 98 are respectively disposed at opposite sides of the front end 46 and each includes an aperture 100. The distance between the plates 98 is substantially equal to the distance between the sidewalls 30 of adjacent dividers 28 of the bed 23. As seen in FIGS. 1 and 15, a pallet 34 is locked to a lower pallet 34 in a stacked arrangement by the bolts 86 of the lower locking structure 82 of the upper pallet 34 being disposed through the apertures 100 of respectively associated plates 98 of the upper locking structure 97, in the same manner previously discussed as to the bolts 86 and the keepers 32 of the bed 23.

Each pallet 34 also advantageously has a guiding and alignment structure to properly align a pallet 34 in a bay of the bed 23 or to another pallet 34 in a stacked arrangement. The lower end 40 of the frame structure 36 of each pallet 34 has a lower guiding structure 102 which, as seen in FIG. 3, includes a stop receptacle 103 having an upper flange 104 and a lower flange 106 substantially parallel to the upper flange 104. The upper and lower flanges 104, 106 are disposed at the rear end 48 of the pallet 34. The lower flange 106, as seen in FIG. 6, has two pairs of spaced-apart cutouts 108.

Figure 5:
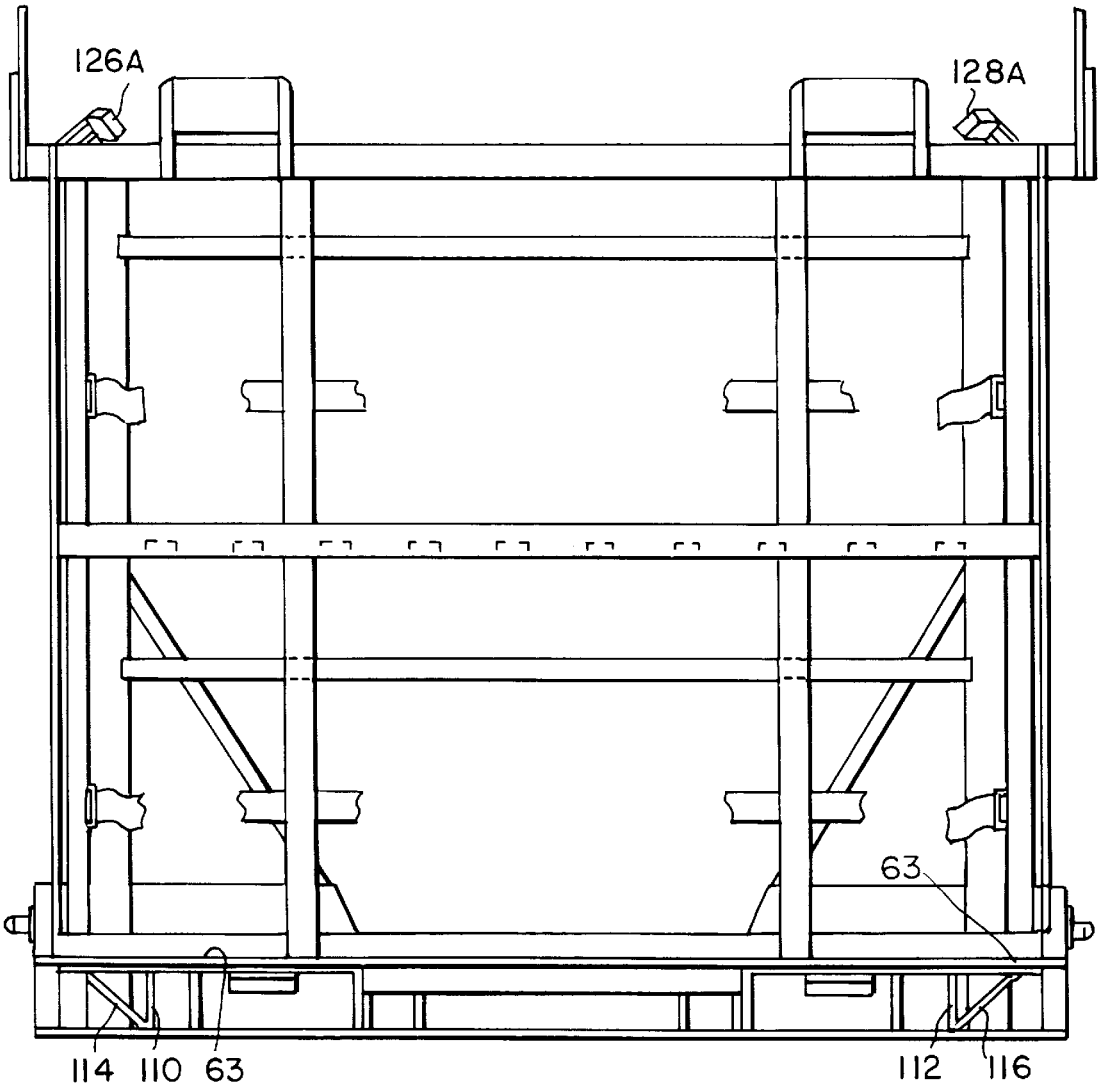
FIG. 5 is a rear elevation view of the pallet of FIG. 2.
Figure 6:
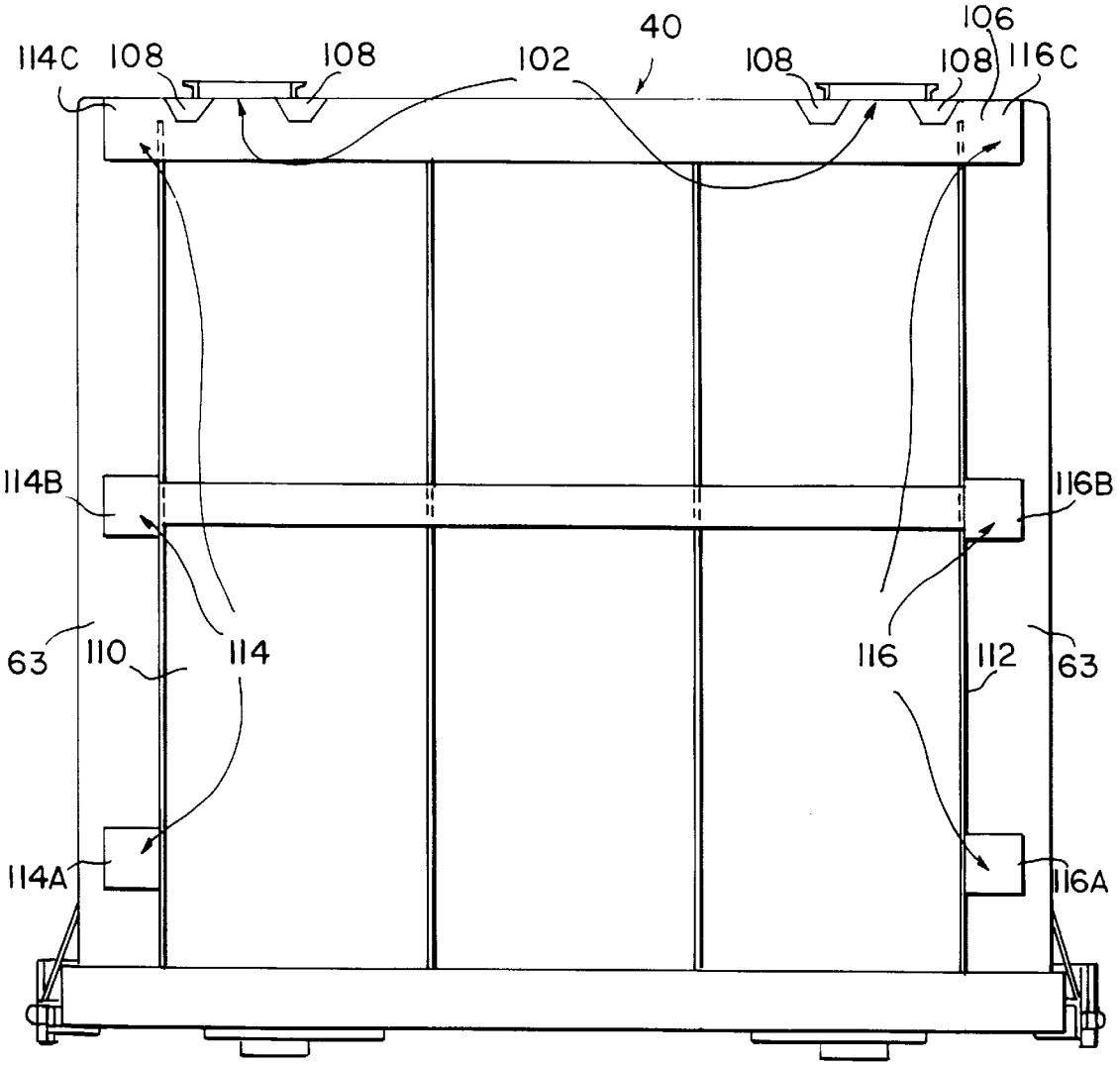
FIG. 6 is a bottom plan view of the pallet of FIG. 2.

The pallet 34, as seen in FIGS. 2, 5 and 6, includes vertical first and second outer support bars 110, 112 depending from the lower base floor 63. The lower guiding structure 102 also includes first and second sets of inclined surfaces 114, 116. As seen in FIGS. 3 and 5, the first set of inclined surfaces 114 include substantially co-planar spaced-apart surfaces 114A–C which run from the bottom of the first bar 110 toward the lower base floor 63 and which are inclined with respect thereto. The second set of inclined surfaces 116 include substantially co-planar spaced-apart surfaces 116A–C which run from the second bar 112 toward the lower base floor 63 and which are inclined with respect thereto. Surfaces 114C and 116C are integral with opposite ends of lower flange 106 (FIG. 6). Surfaces 114A–C are inclined in an opposite direction from that of surfaces 116A–C relative to the lower base floor 63.

As seen in FIG. 9, the upper end 38 of the frame structure 36 includes an upper guiding structure 118 engageable with the lower guiding structure 102 to properly align two pallets 34 in a stacked arrangement. The upper guiding structure 118 includes two stop members 120. Each stop member 120 includes a pair of posts 122 connected to and projecting upwardly from the upper member 54 and a semi-cylindrical bar 124 connecting the posts 122 and spaced above the upper member 54.

Figure 7:
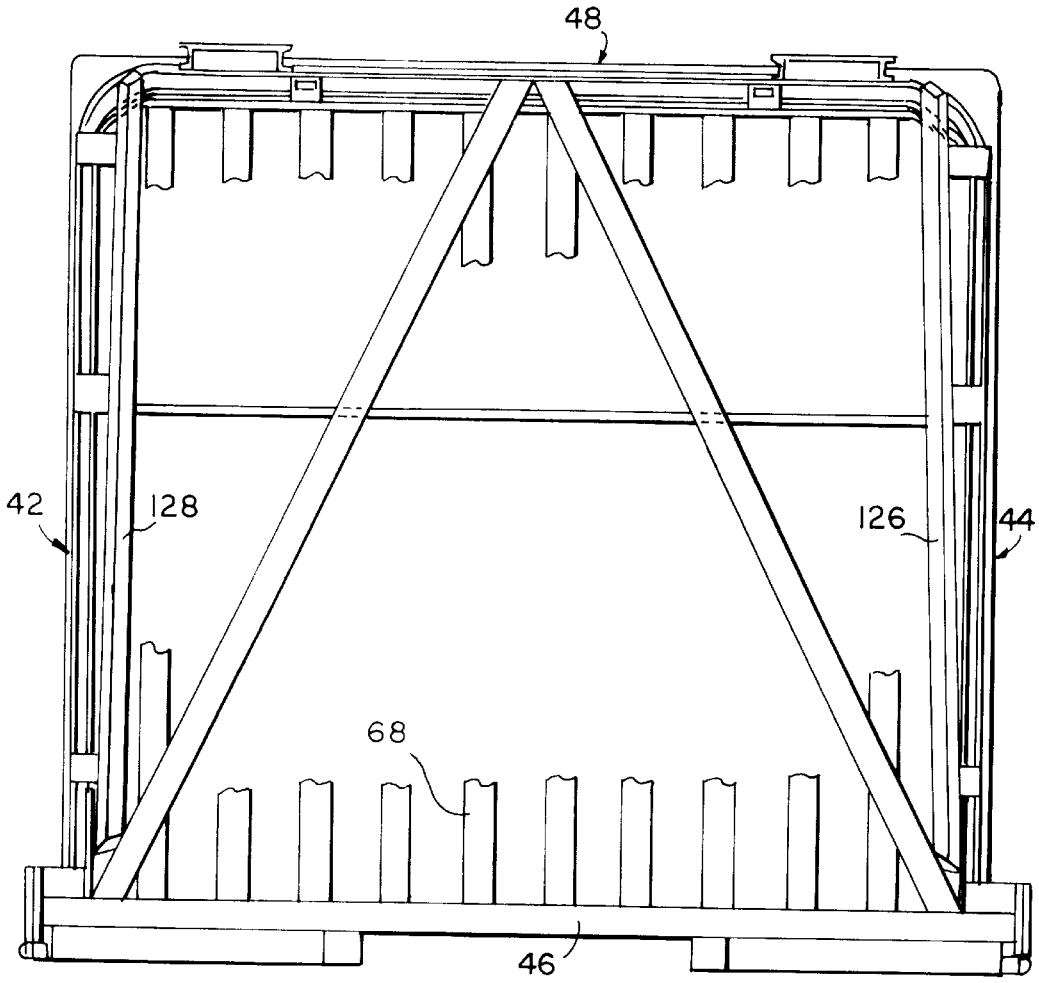
FIG. 7 is a top plan view of the pallet of FIG. 2.
Figure 8:
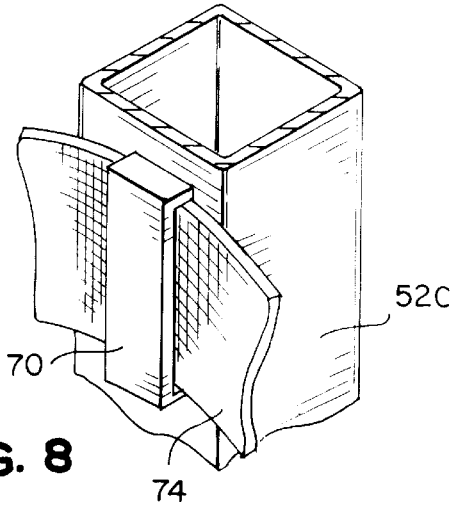
FIG. 8 is an enlarged, fragmentary, perspective view in partial section of one of the frame posts, belt loop, and locking belt of the pallet of FIG. 2.

The upper guiding structure 118 also includes first and second elongated guide bars 126, 128, respectively connected to and disposed above the upper member 54 at sides 44, 42 and respectively having first and second surfaces 126A, 128A. First surface 126A is inclined in an opposite direction from that of second surface 128A with respect to the lower base floor 63. The first and second surfaces 126A, 128A are, respectively, inclined in the same direction as the first and second set of inclined surfaces 114, 116. As seen in FIG. 7, the guide bars 126, 128, respectively, extend along the majority of the length of sides 44, 42 and converge toward each other in a direction from the front end 46 toward the rear end 48.

Two pallets 34 are stacked on the bed 23. A first pallet 34 is lifted by a fork lift truck in a known manner. The fork is tilted down so that the stop receptacle 103 is tilted down by the truck to engage the center beam 26 (FIG. 3) of the bed 23 and the pallet 34 is lowered into a bay and locked to the dividers 28 as described above. The guiding of the pallet 34 onto the bed 23 is more fully described in U.S. Pat. No. 3,993,344 to Bennett and entitled "Transporting System", the disclosure of which is incorporated herein by reference.

Figure 14:
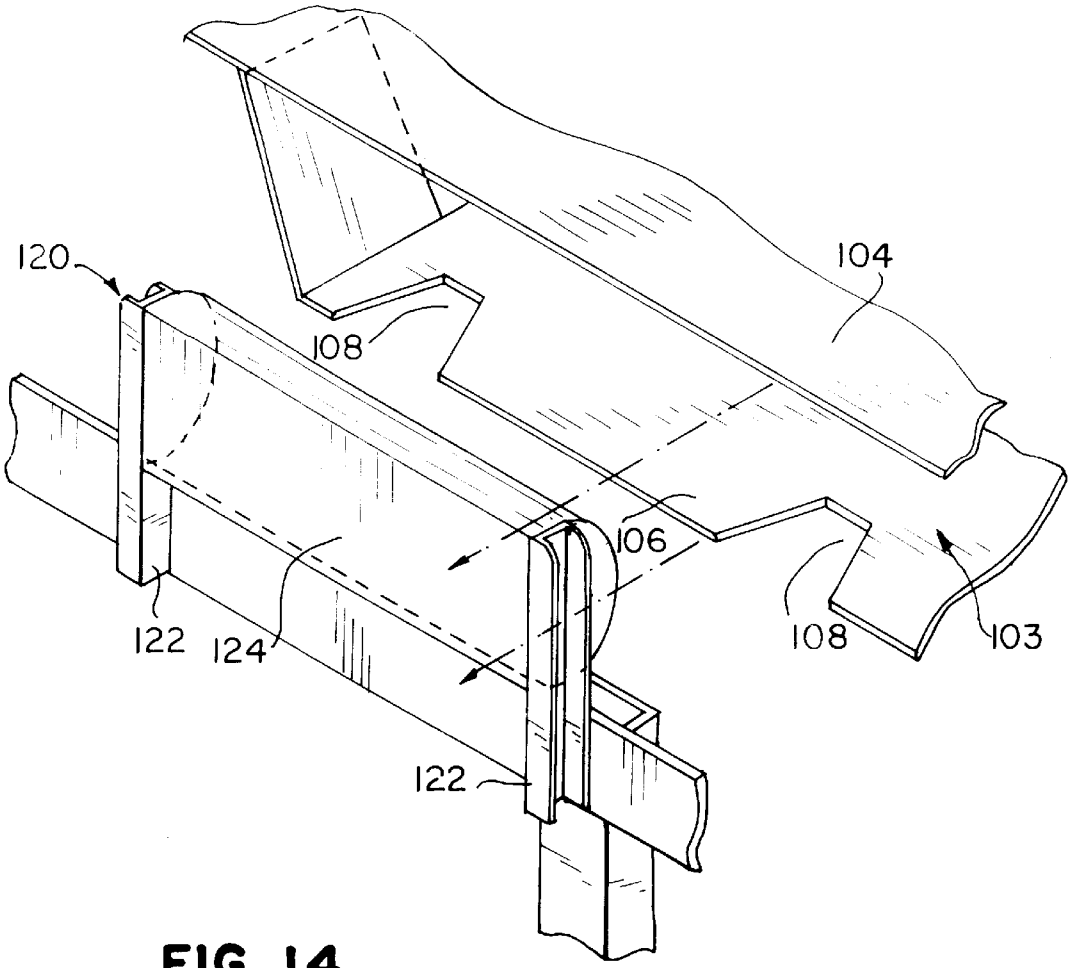
FIG. 14 is an enlarged, fragmentary, perspective view of the stop member of one pallet disposed for engagement with the stop receptacle of another.
Figure 13:
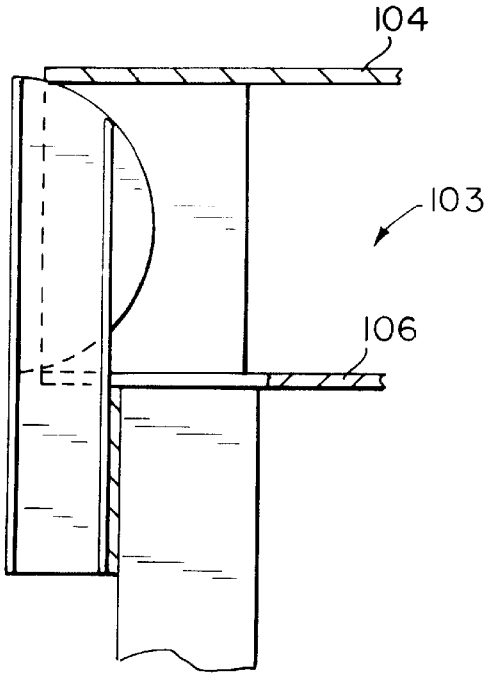
FIG. 13 is an enlarged, fragmentary, side elevation view in partial section of the stop member of one pallet engaged with the stop receptacle of another.

The second pallet 34 is lifted by a fork lift truck above the first pallet (as seen in FIG. 1). Referring to FIGS. 13 and 14, each pair of cutouts 108 of the stop receptacle 103 of the first or lowermost pallet is aligned with a pair of posts 122 of a stop member 120 of the upper pallet 34. The fork lift truck is then driven forward until the upper and lower flanges 104, 106 engage and are stopped by the semi-cylindrical bars 124, whereby a portion of each semi-cylindrical bar 124 is disposed between flanges 104, 106.

Figure 12:
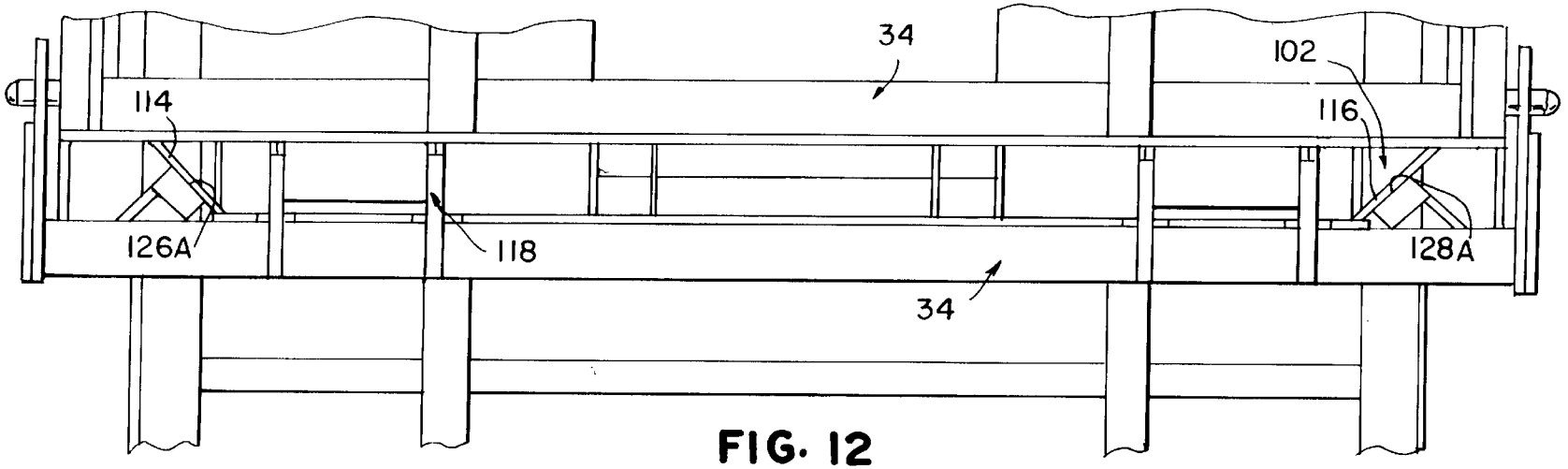
FIG. 12 is a fragmentary, rear elevation view of the combination of FIG. 11.

The upper pallet 34 is then lowered and guided properly downward by the first and second set of inclined surfaces 114, 116 at the upper pallet 34 respectively engaging and sliding down the surfaces 126A, 128A of the first and second guide bars 126, 128, of the lower pallet as the pallet 34 is further lowered (FIG. 12).

As the upper pallet 34 is further lowered, its lower locking structure 82 engages the upper locking structure 97 of the lowermost pallet 34 to lock them together as described above.

It will be appreciated that any desired number of pallets 34 could be stacked in this manner and, while the foregoing description is in the context of the bed of a vehicle, they could be stacked on any underlying support surface.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A stackable pallet for transporting gas containers comprising:

a frame structure for supporting the gas containers, the structure including a substantially planar base surface for supporting the gas containers, front and rear ends, first and second substantially parallel sides each having a length, an upper end having an upper guiding structure, the upper guiding structure including first and second elongated guide bars respectively extending along the majority of the length of the first and second sides, the first and second guide bars respectively having first and second upper inclined surfaces converging toward the rear end and toward the base surface, and a lower end including a lower guiding structure shaped and dimensioned to be engageable with the upper guiding structure of a like pallet to properly align two pallets in a stacked arrangement, the lower guiding structure includes first and second lower inclined surfaces disposed for respectively engaging the first and second upper inclined surfaces of another like pallet.

2. The pallet of claim 1, wherein the lower end has a lower locking structure and the upper end includes an upper locking structure shaped and dimensioned to be mateable with the lower locking structure of another like pallet.

3. The pallet of claim 2, wherein the lower locking structure includes a latching mechanism having a spring-biased rod and the upper locking structure includes a plate having an aperture for receiving the rod.

4. The pallet of claim 1, wherein the first upper and lower inclined surfaces are respectively inclined in the same direction with respect to the base surface and the second upper and lower inclined surfaces are respectively inclined in the same direction with respect to the base surface.

5. The pallet of claim 4, wherein the upper guiding structure includes a stop member disposed at the rear end and mateable with the stop member of another like pallet to align the rear ends of the two pallets.

6. The pallet of claim 5, wherein the stop member includes a pair of substantially parallel posts and a bar connecting the posts, the stop receptacle including upper and lower flanges spaced apart a distance large enough to receive at least a portion of the bar therebetween, the lower flange including two cutouts shaped and dimensioned to receive the posts of the stop member of another like pallet.

7. The pallet of claim 6, wherein the bar is semi-cylindrical in cross section.

8. A stackable pallet for transporting gas containers comprising:

a frame structure for supporting the gas containers, the structure including a lower end having a lower locking structure, and an upper end having an upper locking structure shaped and dimensioned to be mateable with the lower locking structure of another like pallet, wherein the frame structure includes a plurality of peripheral posts connecting the upper end to the lower end, and further comprising a plurality of belt loops each disposed on an associated peripheral post and an adjustable lock strap disposed through the belt loops for trapping and maintaining the gas containers on the pallet.

9. The pallet of claim 8, wherein the upper locking structure includes first and second plates each having an aperture, the lower locking structure having first and second bolts respectively removably disposable in the apertures of the first and second plates of another like pallet.

10. The pallet of claim 8, wherein the upper end includes an upper guiding structure and the lower end includes a lower guiding structure shaped and dimensioned to be engageable with the upper guiding structure of a like pallet to properly align two pallets in a stacked arrangement.

11. The pallet of claim 10, wherein the frame structure includes a substantially planar base surface for supporting the gas containers, the upper guiding structure includes first and second upper inclined surfaces which converge toward the base surface, and the lower guiding structure includes first and second lower inclined surfaces disposed for respectively engaging the first and second upper inclined surfaces of another like pallet.

12. The pallet of claim 8, and further comprising a base surface for supporting the gas containers, a first peripheral bar connected to the posts disposed at a height above the base surface substantially equal to the height of a neck of a liquid propane cylinder supported on the base surface, and a second peripheral bar connected to a plurality of the posts at a height above the base surface substantially equal to the height of a base ring of the liquid propane cylinder.

13. The pallet of claim 8, wherein the lower locking structure includes a latching mechanism having a spring-biased rod and the upper locking structure includes a plate having an aperture for receiving the rod.

14. A stackable pallet system for transporting gas containers comprising:

a plurality of pallets, each pallet including a frame structure for supporting the gas containers, the structure including a lower end having a lower locking structure, and an upper end having an upper locking structure mateable with the lower locking structure of another like pallet to lock the pallets in a stacked arrangement, wherein the upper end includes an upper guiding structure and the lower end includes a lower guiding structure shaped and dimensioned to be engageable with the upper guiding structure of a like pallet to properly align two pallets in a stacked arrangement, wherein the frame structure includes a substantially planar base surface for supporting the gas containers and the upper guiding structure includes first and second upper inclined surfaces which converge toward the base surface, and the lower guiding structure includes first and second lower inclined surfaces of another like pallet.

15. The system of claim 14, wherein the first upper and lower inclined surfaces are respectively inclined in the same direction with respect to the base surface and the second upper and lower inclined surfaces are respectively inclined in the same direction with respect to the base surface.

16. The system of claim 15, wherein the frame structure includes front and rear ends, and first and second substantially parallel sides each having a length, the upper guiding structure including a stop member disposed at the rear end, the lower guiding structure including a stop receptacle disposed at the rear end and mateable with the stop member of another like pallet to align the rear ends of two pallets.

17. The system of claim 16, wherein the stop member includes a pair of substantially parallel posts and a bar connecting the posts, the stop receptacle including upper and lower flanges spaced apart a distance large enough to receive at least a portion of the bar, the lower flange including two cutouts shaped and dimensioned to receive the posts of the stop member of another like pallet.

18. The system of claim 16, wherein the bar is semi-cylindrical in cross section.

19. The system of claim 16, wherein the upper guiding structure includes first and second elongated guide bars respectively disposed by and running along the majority of the length of the first and second sides, the first and second guide bars spaced apart a greater distance by the front end than the rear end whereby the first and second guide bars converge towards one another, the first and second upper inclined surfaces respectively disposed on the first and second guide bars.

20. The system of claim 14, wherein the upper locking structure includes first and second plates each having an aperture, the lower locking structure having first and second bolts respectively removably disposable in the apertures of the first and second plates of another like pallet.

21. The system of claim 20, wherein the frame structure includes a plurality of peripheral posts connecting the upper end to the lower end, and further comprising a plurality of belt loops each disposed on an associated peripheral posts and an adjustable lock strap disposed through the belt loops for trapping and maintaining the gas cylinders on the pallet.

22. The system of claim 14, wherein the latching mechanism includes a plate having an aperture for receiving the rod.

* * * * *